US008308626B2

(12) United States Patent
Klintenstedt

(10) Patent No.: US 8,308,626 B2
(45) Date of Patent: Nov. 13, 2012

(54) ROTOR UNIT FOR A CENTRIFUGAL SEPARATOR HAVING UNDETACHABLY JOINED SEPARATING DISCS

(75) Inventor: Kjell Klintenstedt, Saltsjö-Bo (SE)

(73) Assignee: Alfa Laval Corporate AB, Lund (SE)

( * ) Notice: Subject to any disclaimer, the term of this patent is extended or adjusted under 35 U.S.C. 154(b) by 671 days.

(21) Appl. No.: 12/295,651

(22) PCT Filed: Mar. 29, 2007

(86) PCT No.: PCT/SE2007/000307
§ 371 (c)(1),
(2), (4) Date: Oct. 21, 2008

(87) PCT Pub. No.: WO2007/114766
PCT Pub. Date: Oct. 11, 2007

(65) Prior Publication Data

US 2009/0137378 A1 May 28, 2009

(30) Foreign Application Priority Data

Apr. 4, 2006 (SE) ..... 0600761

(51) Int. Cl.
*B04B 1/08* (2006.01)

(52) U.S. Cl. ..... 494/64; 494/68; 494/70

(58) Field of Classification Search ..... 494/64, 494/67–73
See application file for complete search history.

(56) References Cited

U.S. PATENT DOCUMENTS 920,481 A * 5/1909 Kimball ..... 494/64
1,784,510 A 12/1930 Berline
2,725,190 A 11/1955 Hein; et al.
3,335,946 A * 8/1967 Putterlik ..... 494/73
4,071,188 A * 1/1978 Afonin et al. ..... 494/70
4,108,354 A * 8/1978 Madsen ..... 494/43
4,142,671 A * 3/1979 Ivin et al. ..... 494/73
4,262,841 A * 4/1981 Berber et al. ..... 494/66

(Continued)

FOREIGN PATENT DOCUMENTS

GB 2169225 A 7/1986

(Continued)

OTHER PUBLICATIONS

International Search Report dated Jun. 25, 2007.

*Primary Examiner* — Charles E Cooley
(74) *Attorney, Agent, or Firm* — Michaud-Kinney Group LLP

(57) ABSTRACT

A rotor unit for a centrifugal separator, which centrifugal separator comprises a non-rotatable housing wherein the rotor unit is disposed about a central axis of rotation, an inlet for supply of a mixture of components to be separated, at least one outlet for a component separated during operation, whereby the rotor unit, at least parts of which are made of metal, comprises a separating chamber formed inside the rotor unit, an inlet chamber connected to the inlet and the separating chamber, is formed radially within said separating chamber and is usually shielded from the separating chamber, at least one outlet connected to the separating chamber, a plurality of separating discs disposed at a distance axially from one another in said separating chamber coaxially with the axis of rotation, at least a number of the metal parts of said rotor unit are undetachably joined together to form a composite assembly.

23 Claims, 6 Drawing Sheets

U.S. PATENT DOCUMENTS

| | | | | |
|---|---|---|---|---|
| 4,464,163 | A * | 8/1984 | Heckmann et al. | 494/64 |
| 5,364,335 | A | 11/1994 | Franzen et al. | |
| 5,762,800 | A | 6/1998 | Meikrantz et al. | |
| 5,851,396 | A * | 12/1998 | Saget | 210/512.3 |
| 6,224,531 | B1 | 5/2001 | Frehland et al. | |
| 6,475,132 | B2 * | 11/2002 | Zettier | 494/65 |
| 7,306,556 | B2 * | 12/2007 | Pitkamaki et al. | 494/67 |
| 7,410,457 | B2 * | 8/2008 | Heinrich | 494/70 |
| 7,731,772 | B2 * | 6/2010 | Lagerstedt et al. | 55/407 |
| 2004/0029696 | A1 * | 2/2004 | Mackel et al. | 494/36 |
| 2006/0100083 | A1 * | 5/2006 | Lagerstedt et al. | 494/70 |
| 2006/0135339 | A1 * | 6/2006 | Sandgren | 494/68 |
| 2010/0099545 | A1 * | 4/2010 | Klintenstedt | 494/79 |
| 2011/0195832 | A1 * | 8/2011 | Rudman et al. | 494/73 |
| 2011/0212821 | A1 * | 9/2011 | Mackel et al. | 494/68 |
| 2011/0237417 | A1 * | 9/2011 | Rudman et al. | 494/70 |

FOREIGN PATENT DOCUMENTS

| | | | |
|---|---|---|---|
| JP | 2010-274210 | * | 12/2010 |
| WO | 9627445 A1 | | 9/1996 |

* cited by examiner

ROTOR UNIT FOR A CENTRIFUGAL SEPARATOR HAVING UNDETACHABLY JOINED SEPARATING DISCS

BACKGROUND TO THE INVENTION, AND STATE OF THE ART

An example of a centrifugal separator is referred to in WO 90/04460. In that centrifugal separator, the inlet chamber is shielded from separating chamber by a dividing wall in the form of seal means which are disposed in recesses in the separating discs or are integrated with the respective separating discs if the separating discs and the seal means are made of plastic. In addition to having to cater to a large number of separating discs, the seal means disposed in recesses in the separating discs entail problems in catering to many more parts which will, if the seal means are for example made of a rubber material, be liable to wear and have to be replaced at regular intervals. Seal means integrated with the respective separating discs and made of plastic involve limitations with regard to the strength of the separating discs. The material characteristics of the discs and seals also limit the applications for which the centrifugal separator can be used.

A common way of holding rotor parts of the kind indicated above together is to cause them to be in engagement with one another by means of threaded connections as referred to in WO 90/04460. The separating discs are held securely in place by rods and are compressed by a compression tool to increase the rigidity of the fitted separating discs. Compression of the separating discs presses them together so much as to affect their symmetry and mutual positioning, thus possibly causing imbalance which might be critical when the rotor rotates.

SUMMARY OF THE INVENTION

The object of the present invention is to eliminate the problems identified above and provide a rotationally dynamically stable rotor unit for a centrifugal separator, which rotor unit will maintain or improve the effectiveness of separation.

Another object is to provide a rotor unit for a centrifugal separator, which rotor unit is easy to fit and remove as a result of reducing the number of separate constituent parts of the centrifugal separator.

These and other objects are achieved by a rotor unit for a centrifugal separator, which centrifugal separator comprises a non-rotatable housing in which said rotor unit is arranged for rotation and comprises at least a number of parts made of metal, an inlet for supply of a liquid mixture of components which is to be separated, and at least one outlet for a component separated during operation, whereby the rotor unit comprises a separating chamber formed within the rotor unit, an inlet which is connected to the inlet and to the separating chamber, is formed radially within said separating chamber and is usually shielded from the separating chamber, at least one outlet connected to the separating chamber, and a number of separating discs disposed at a distance axially from one another in said separating chamber coaxially with the axis of rotation. At least some of the metallic parts of the above-described rotor unit are undetachably joined together to form a composite assembly.

According to an embodiment of the present invention, the rotor unit comprises parts joined together by soldering.

Joining parts of the rotor unit together by soldering means that thinner separating discs can be used in the same space, making it possible to use more separating discs and thereby enhance the effectiveness of separation.

The binding agent used in the soldering may be a corrosion-resistant solder which has substantially better characteristics than an ordinary solder. Corrosion-resistant solder eliminates, for example, corrosion problems in the centrifugal separator. Examples of other solders which may be used are ones based on copper, nickel or iron. Examples of the composition and characteristics of a suitable solder appear in, for example, WO 02/38327 A1 or WO 02/098600 A1.

According to a further embodiment of the invention, the rotor unit comprises parts where the solder readily constitutes a dividing wall between the inlet chamber and the separating chamber. The soldered dividing wall also results in a more uniform pressure drop in intermediate spaces between the separating discs, leading to better flow distribution in the intermediate spaces of the separating discs and hence to a better degree of separation.

The separating discs are one example of parts which may be joined together by soldering, but there may also be parts disposed at the inlet for the supply of liquid mixture which is to be separated, parts disposed at the outlet for separated components, entrainment means etc.

The separating discs may be undetachably joined together either at their radially inner portions and/or at their radially outer portions. Joining the separating discs together at their radially inner edges results in the formation of a dividing wall which represents a demarcation between the inlet chamber and the separating chamber as above. The intermediate spaces between the separating discs may be open to the space between the rotor unit and the surrounding non-rotatable housing, but if the separating discs are joined together at their radially outer edges along a line surrounding an axis of rotation, the assembly in each intermediate space forms dividing walls which together constitute a rotor housing. Joining said separating discs together by soldering results in the formation of a rigid and stable rotor unit.

As previously mentioned, parts of the outlet may also be joined to the separating discs to form an integrated unit. In such cases the outlet may comprise elements in the form of, for example, conical parts of the separating discs which are lengthened radially inwards and disposed at a suitable axial level relative to the inlet. The outlet may also comprise one or more end-plates disposed at one end of the stack of separating discs to form an outlet for one of the liquid components being separated. In an embodiment where an ordinary outlet device is replaced by an outlet device according to the present invention and the separating discs are joined together to form a homogeneous package, space can be used effectively so that the number of separating discs in the rotor unit is increased, enhancing the effectiveness of separation.

According to a further embodiment of the invention, the rotor unit comprises parts joined together by welding. In this case the welds may likewise constitute said dividing wall.

BRIEF DESCRIPTION OF THE DRAWINGS

The invention will now be explained in more detail by describing various embodiments with reference to the attached drawings.

DETAILED DESCRIPTION OF VARIOUS EMBODIMENTS OF THE INVENTION

Figure 1:
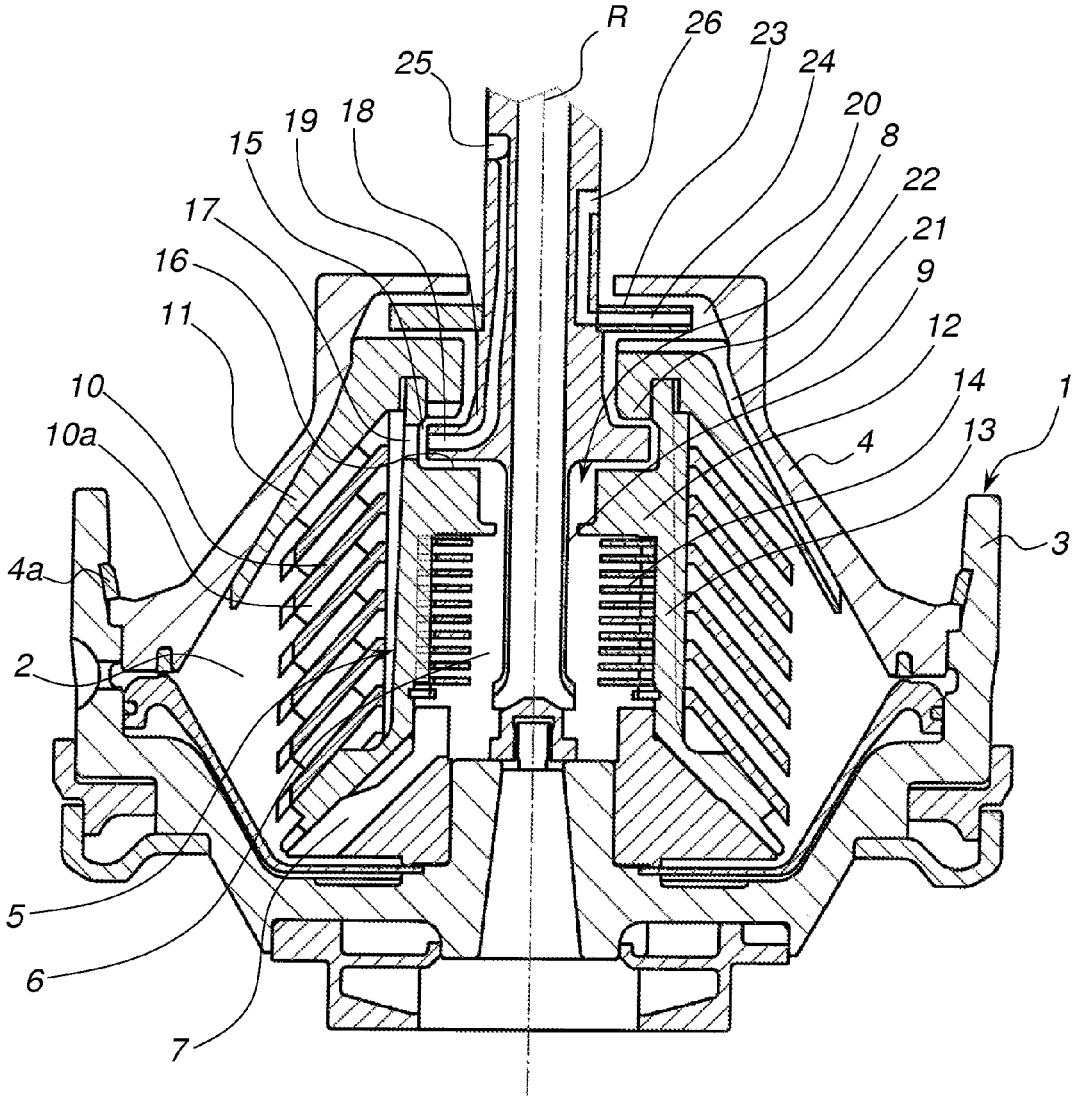
Fig. 1 (Prior Art)
FIG. 1 depicts schematically a conventional rotor unit for a centrifugal separator in axial section.

FIG. 1 depicts a conventional rotor unit comprising a rotor body 1 which is rotatable about an axis of rotation R and delineates a separation chamber 2. The rotor body 1 comprises a base part 3 and a partly conical upper part 4 which are held together axially at their circumferential portions by a locking ring 4*a*. An inlet device 5 is disposed centrally in the rotor body 1 for rotation with the rotor body 1. The inlet device 5 delineates an inlet chamber 6 which communicates with the separating chamber 2 via a number of ducts 7 formed inside the rotor body 1. The inlet device 5 also has at one of its ends an aperture 8 which communicates with the inlet chamber 6. A non-rotatable inlet pipe 9 for supply of a liquid mixture which is to be treated in the rotor unit extends into the inlet chamber 6 from outside and leads to the inner portion of the latter. A stack of truncated conical separating discs 10 axially separated by spacing means 10*a* so that they delineate between them narrow flow paths for said liquid mixture to flow through is disposed in the separating chamber 2. The axial distance between the separating discs 10 depicted in FIG. 1 is only schematic and may vary depending on the number of separating discs in the stack and the height of the spacing means 10*a*. The stack of separating discs 10 is held in place axially by a substantially conical inner part 11 which itself is held in place by the upper part 4. The polar control of the stack of separating discs 10 is by axial ribs (not depicted) disposed on the outside of the inlet device 5.

The inlet device 5 comprises a central body 12 constituting a dividing wall 13 between the inlet chamber 6 and the separating chamber 2, and an entrainment device situated in the inlet chamber 6. Various different entrainment device configurations are possible and their purpose is to entrain during operation the liquid mixture which, as the rotor rotates, enters the inlet chamber 6 via the inlet pipe 9. FIG. 1 illustrates a number of entrainment means 14 in the form of a stack of annular flat discs adapted to surrounding the axis of rotation R at some axial distance from one another. The entrainment means configuration may however take any other suitable form desired, such as a plurality of blades distributed about the axis of rotation R and each extending radially and axially.

In a cylindrical section at an axial distance from the inlet chamber 6, the central body 12 forms a first discharge chamber 15 in which a specific light liquid component separated from the liquid mixture during operation accumulates, whereby the cylindrical section delineates the first discharge chamber 15 radially outwards relative to the separating chamber 2. The first discharge chamber 15 is delineated axially by an annular endwall and a radially inner portion of the substantially conical part 11.

The discharge chamber 15 communicates with the separating chamber 2 via at least one duct 17. FIG. 1 depicts one duct 17. The duct has an inlet aperture situated at a chosen axial level in or outside the stack of separating discs 10, and an outlet aperture situated at a chosen radial level in the discharge chamber 15. A non-rotatable discharge means 18 is disposed in the discharge chamber 15 to discharge the specific light component from the rotor unit. In the discharge chamber 15, the specific light component forms a rotating body of liquid with a free liquid surface facing radially inwards and situated at a radial level determined by the backpressure in an outlet duct 19 in the non-rotatable discharge means 18. In the centrifugal separator according to FIG. 1, the location of the duct 17 is such that its outlet aperture leads directly out into the discharge chamber 15. According to another known example, the duct 17 is displaced axially towards the inlet chamber 6 so that the outlet aperture of the duct 17 leads radially to within the radial level for the free liquid surface, causing this radial level in the separating chamber 2 and not the radial level for the free liquid surface in the discharge chamber 15 to be the determinant liquid level.

The centrifugal separator according to FIG. 1 has in addition a further discharge chamber 20 for discharging a specific heavy liquid component, which chamber communicates with a radially outer part of the separating chamber 2 via at least one passage 21 which is separated from radially inner parts of the separating chamber 2 by said conical part 11 which at the same time constitutes a second endwall 22. A non-rotatable discharge means 23 with an outlet duct 24 is likewise disposed in this discharge chamber. This outlet duct 24 and the previously mentioned outlet duct 19 are each connected to their respective outlets 25 and 26.

Figure 2:
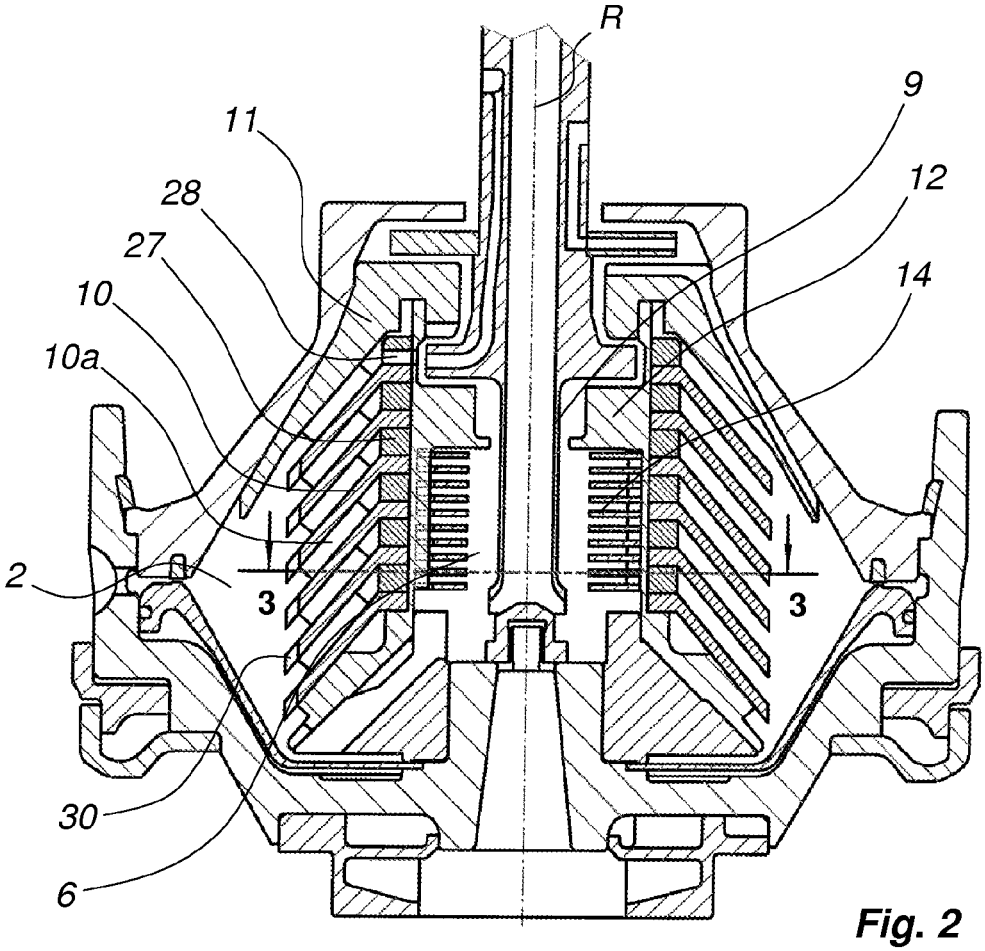
FIG. 2 depicts schematically a rotor unit according to an embodiment of the invention in axial section.

FIG. 2 depicts an embodiment of a rotor unit according to the present invention. Items which form part of the invention as well as the state of the art bear the same reference notations in the various drawings. In the rotor unit according to FIG. 2, the separating discs 10 are made of metal and joined together at their radially inner portions by joints 27. The joints 27 may be soldered or welded joints. The duct 17 according to FIG. 1 is represented in FIG. 2 by the duct 28. In FIG. 2, the duct 28 is part of the stack of separating discs 10. The axial position of the duct 28 may be chosen by omitting joints 27 between a number of separating discs 10.

Figure 3:
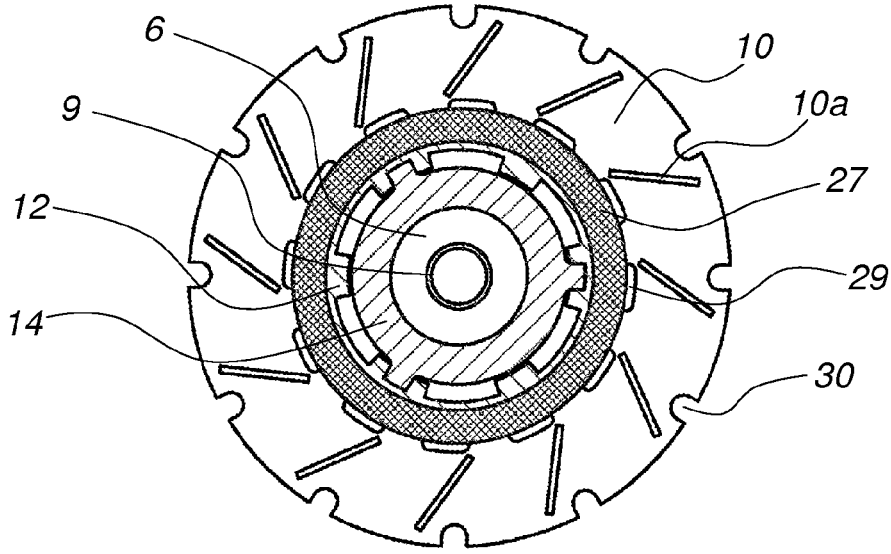
FIG. 3 depicts schematically a cross-section through part of the rotor unit along the line A-A in FIG. 2.

FIG. 3 depicts a cross-section through part of the rotor unit at the stack of separating discs 10 along the line A-A in FIG. 2, illustrating one side of a separating disc 10 and how it is joined to the central body 12 by the joint 27. FIG. 3 also depicts the inlet chamber 6, the inlet pipe 9 and an entrainment means 14 in the form of a disc. The separating disc 10 according to FIG. 3 is provided with a number of holes 29 evenly distributed about the axis of rotation. These holes 29 form axial ducts in the stack of separating discs 10 for leading the separated specific light liquid component towards the duct 28. The separating disc 10 is also provided with a number of recesses 30 at its radially outer portion which likewise constitute axial ducts in the stack of separating discs 10 for leading the not yet separated liquid mixture towards the substantially conical part 11. Alternatively, the axial edges may instead take the form of holes in the separating disc 10. The radial positioning of these holes depends on whether it is the specific light or the specific heavy liquid component which is to be purified. If the holes are situated radially at the periphery of the separating disc, the specific light liquid component will be purified more effectively because it then has a longer path in the space between the separating discs. If the holes are situated instead radially closer to the centre of the separating disc, the specific heavy liquid component will be purified more effectively because it then has a longer path in the space between the separating discs. The separating disc 10 is also provided with a number of spacing means 10*a* in the form of elevations evenly distributed about the axis of rotation. The elevations may be elongate, dotlike, arcuate or of any suitable shape appropriate to the particular application. The elevations may be situated on the upper or lower side of the separating disc 10.

Figure 4:
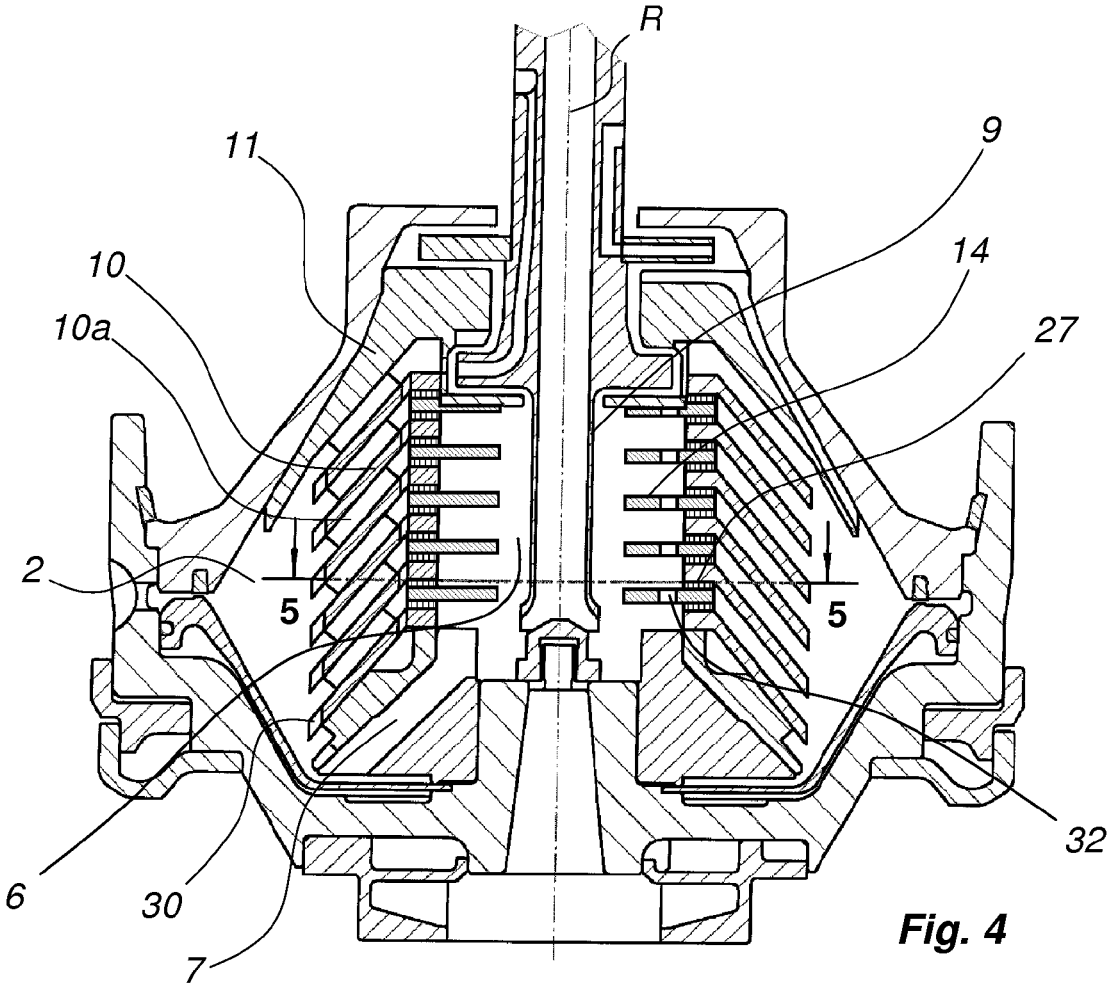
FIG. 4 depicts schematically a rotor unit according to a further embodiment of the invention in axial section.

FIG. 4 depicts a further embodiment of a rotor unit according to the present invention. In this rotor unit, entrainment means 14 are likewise joined to the separating discs 10 by said joints 27. As may be seen in FIG. 4, the entrainment means 14 may be placed overlapping the separating discs 10 and thereafter be joined to them.

Figure 5:
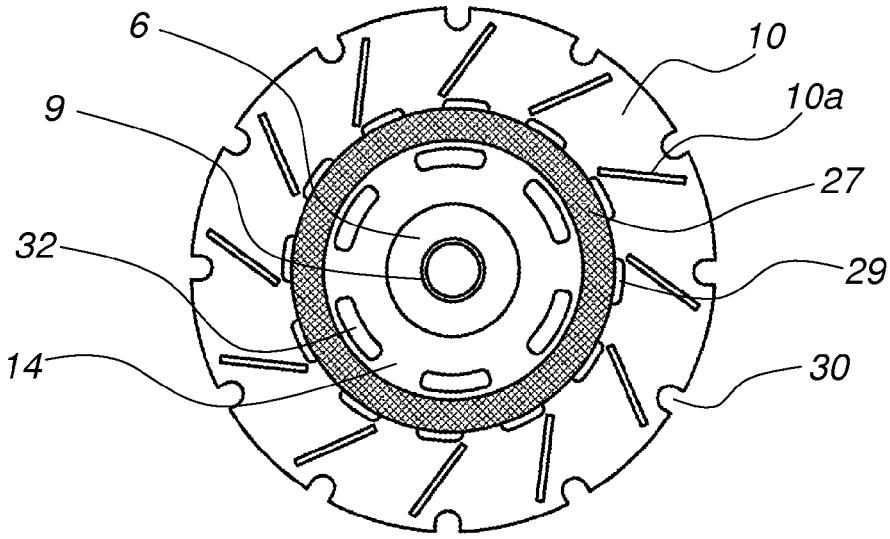
FIG. 5 depicts schematically a cross-section through part of the rotor unit along the line A-A in FIG. 4.

FIG. 5 depicts a cross-section through part of the rotor unit at the stack of separating discs 10 along the line A-A in FIG. 1, illustrating one side of a separating disc 10 and how it is joined to an entrainment means 14 by the joint 27. In this case the joint 27 constitutes a dividing wall between the inlet chamber 6 and the separating chamber 2 (see FIG. 4). Like the separating discs 10, the entrainment means 14 is provided with a number of holes 32 evenly distributed about the axis of rotation. These holes 32 also constitute axial ducts for leading the incoming entrained liquid component towards the ducts 7.

Figure 6:
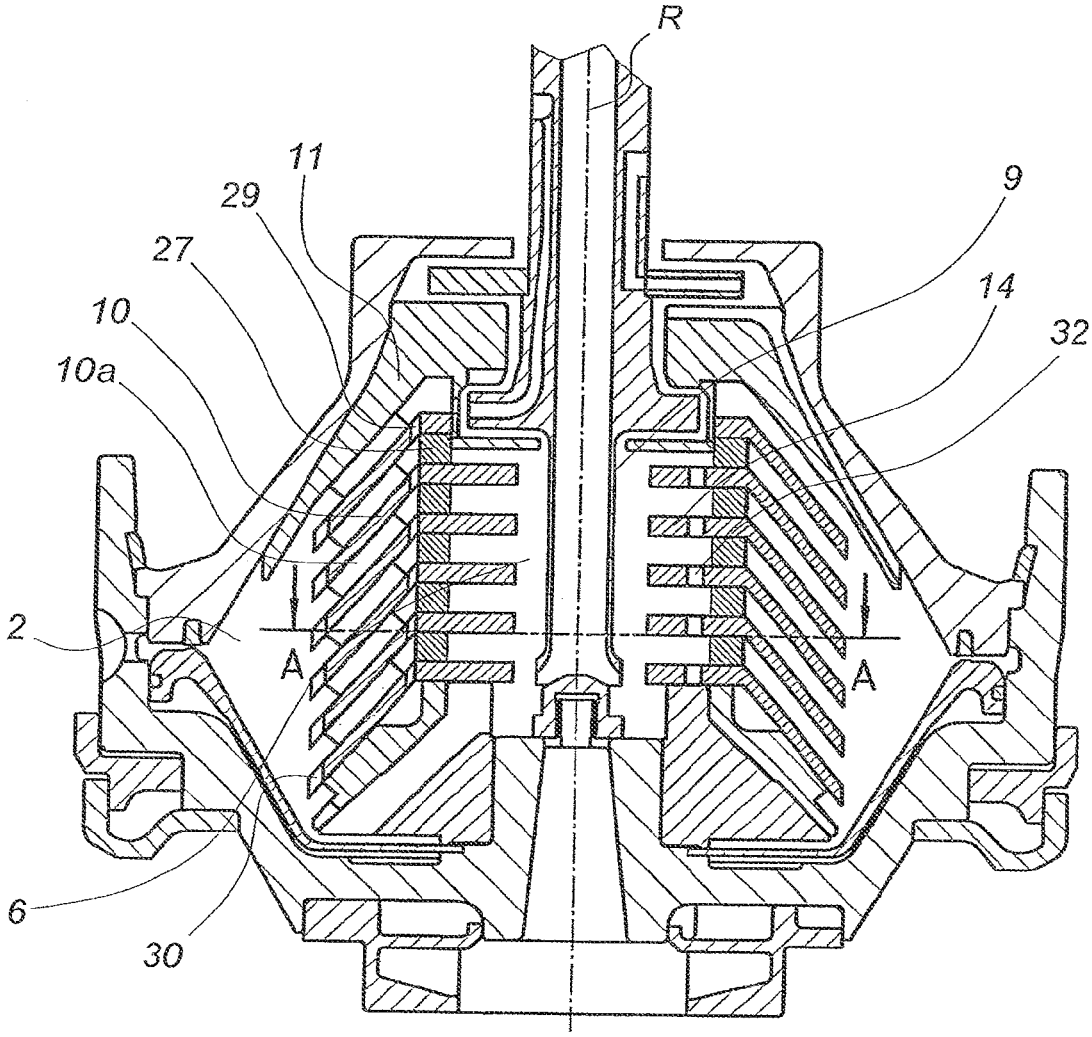
FIG. 6 depicts schematically a rotor unit according to a further embodiment of the invention in axial section.

FIG. 6 depicts a further embodiment of a rotor unit according to the present invention. In this rotor unit, entrainment means 14 form part of the separating discs 10. The separating discs 10 are joined together by joints 27 in the same way as in FIG. 4, whereby the joints constitute a dividing wall between the inlet chamber 6 and the separating chamber 2.

The separating discs 10 may also be so disposed that a number of them comprise entrainment means 14, while others do not comprise entrainment means 14 in the stack of separating discs 10. The axial distance between the entrainment means 14 may thus be varied relative to the separating discs 10.

Figure 7:
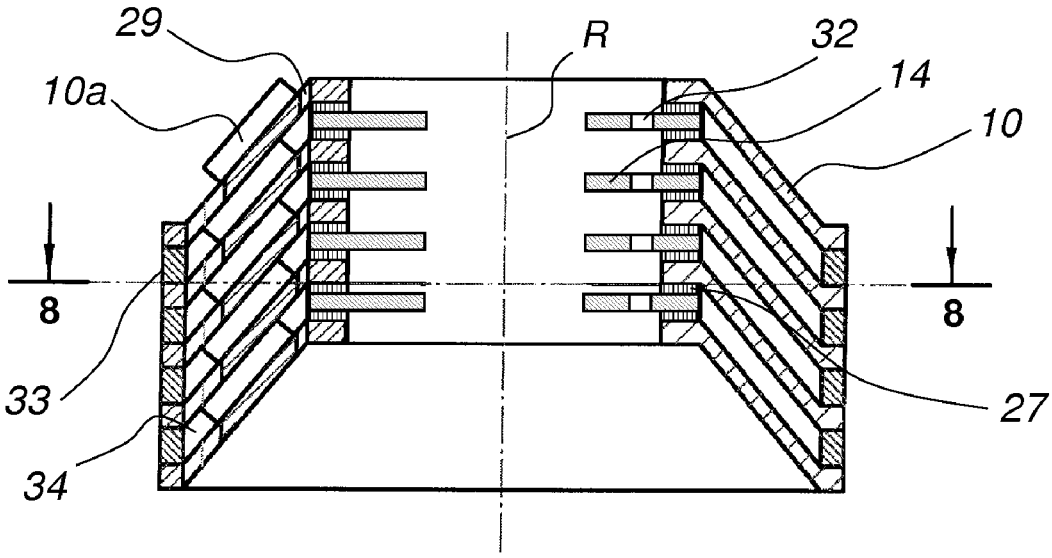
FIG. 7 depicts schematically a number of separating discs according to yet another embodiment of the invention in axial section.

FIG. 7 depicts schematically a number of separating discs according to a further embodiment of the invention in axial section, illustrating the separating discs 10 and how they are joined to the entrainment means 14 by the joints 27. According to this further embodiment of the invention, the radially outer portions of the separating discs 10 are also joined together by joints 33. The joints 33 constitute an outer dividing wall between the stack of separating discs 10 and the surroundings. Thus the intermediate space between the discs constitutes the separating space.

Figure 8:
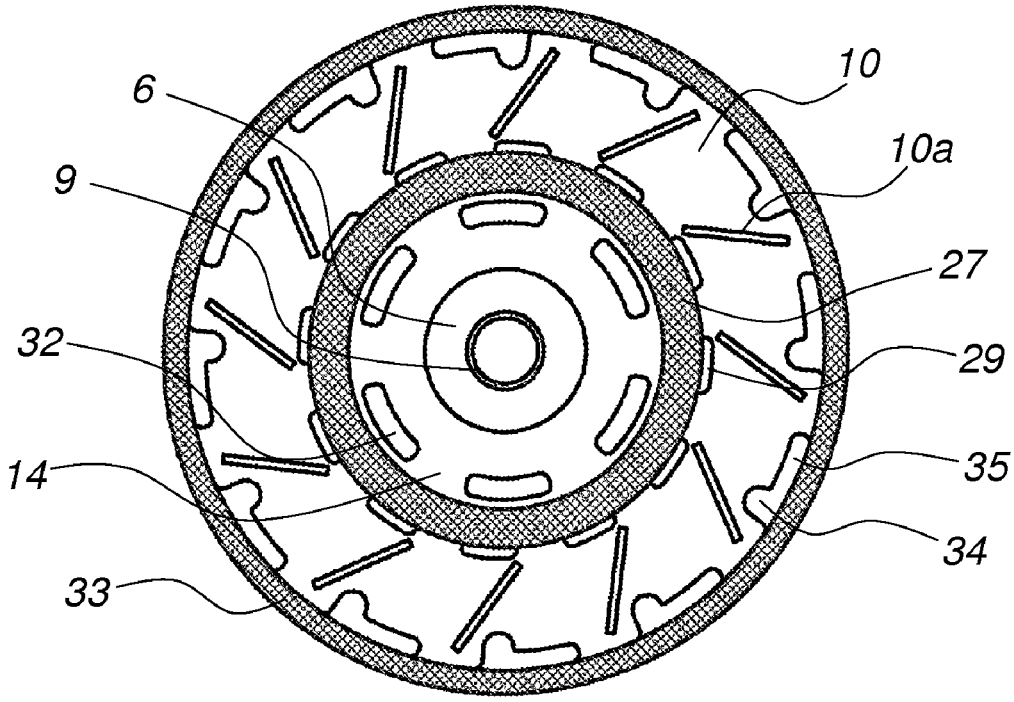
FIG. 8 depicts schematically a cross-section through the separating discs along the line A-A in FIG. 7.

FIG. 8 depicts schematically a cross-section through a number of separating discs along the line A-A in FIG. 7. According to FIG. 8, the separating discs 10 are provided with a number of further holes 34 evenly distributed about the axis of rotation. These holes 34 are situated at radially outer portions of the separating discs 10 but radially within the joints 33 and constitute axial ducts for leading the specific heavy liquid component towards the outlet duct 24. The holes 34 may also have an extension rearwards relative to the direction of rotation and thus constitute ducts 35. These ducts 35 are intended to convey heavier components such as sludge.

Figure 9:
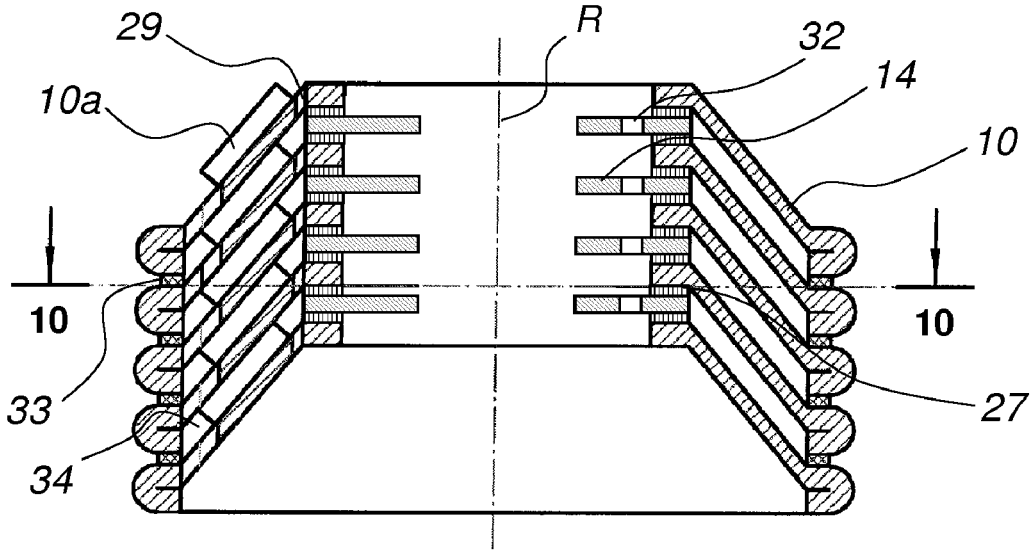
FIG. 9 depicts schematically a number of separating discs according to yet another embodiment of the invention in axial section.
Figure 10:
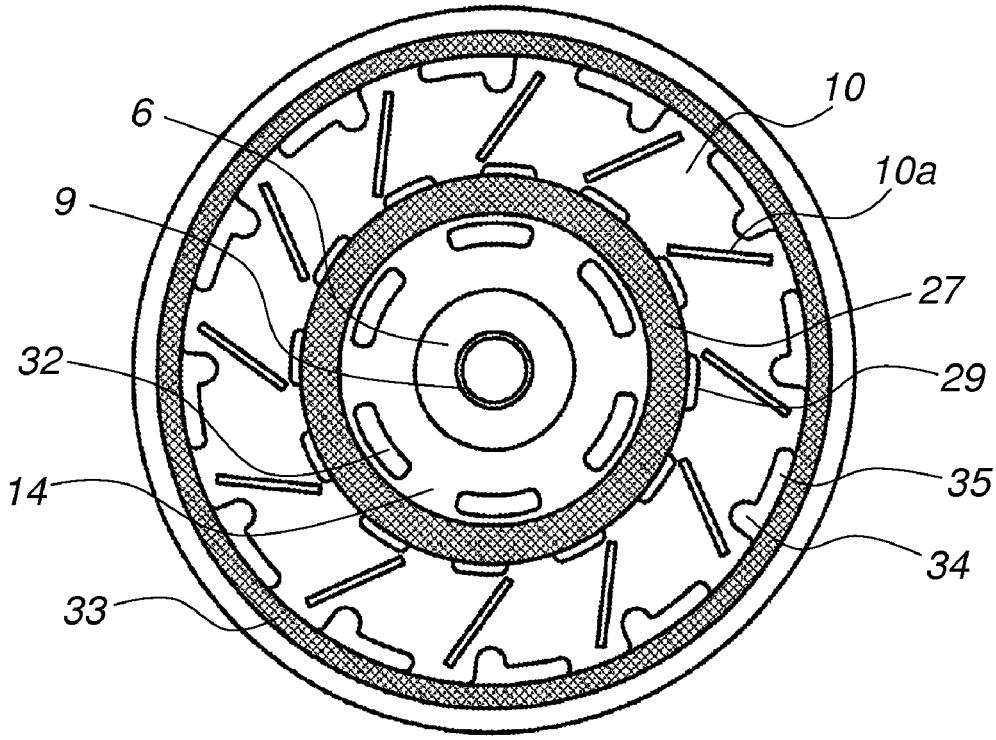
FIG. 10 depicts schematically a cross-section through the separating discs along the line A-A in FIG. 9.

FIG. 9 depicts schematically a number of separating discs according to a further embodiment of the invention in axial section. As may be seen in FIG. 9, the separating discs 10 may be provided with a flange at their radially outer portions with joints between respective separation plates 10 or the configuration of the separating discs 10 may be such that the outer portion is folded in under or over the plate as depicted in FIG. 9. The result is a spacing means between the separating discs at the latter's outer portions and increased rigidity of the rotor unit. FIG. 10 depicts a cross-section through the separating discs along the line A-A in FIG. 9.

The rotor unit is not limited by this orientation according to the drawings but may be oriented in any suitable manner desired, e.g. out from a horizontal axis of rotation or a rotor unit rotated 180° as compared with the drawings.

The rotor unit described above functions in a well-known manner during its rotation.

The scope for using the invention is not limited to the separation of liquid mixtures, as it may also be used for other applications such as the removal from gases of particles suspended in them.

The invention is not limited to the embodiments referred to but may be varied and modified within the scopes of the claims set out below.

What is claimed is:

1. A rotor unit for a centrifugal separator, which centrifugal separator comprises a non-rotatable housing in which the rotor unit is disposed about a central axis of rotation, an inlet for supply to the rotor unit of a mixture of components which are to be separated, and at least one outlet for a component separated during operation in the rotor unit, whereby the rotor unit comprises:

a separating chamber formed inside the rotor unit;

an inlet chamber which is connected to the inlet and to the separating chamber, and which is formed radially within said separating chamber;

at least one outlet connected to the separating chamber; and a plurality of separating discs made of metal and disposed at a distance axially from one another in said separating chamber coaxially with the axis of rotation, and wherein at least two of the separating discs are undetachably joined together to form a composite assembly, wherein the separating discs are joined together by soldering or welding, the soldering or the welding constituting a dividing wall between the inlet chamber and the separating chamber.

2. A rotor unit according to claim 1, wherein the separating discs are made of stainless steel and the separating discs are joined together by soldering with a corrosion-resistant solder.

3. A rotor unit according to claim 1, wherein the separating discs are made of stainless steel and the separating discs are joined together by soldering with a copper-based solder.

4. A rotor unit according to claim 1, wherein the separating discs are made of stainless steel and the separating discs are joined together by soldering with a nickel-based solder.

5. A rotor unit according to claim 1, wherein the separating discs are made of stainless steel and the separating discs are joined together by soldering with an iron-based solder.

6. A rotor unit according to claim 1, wherein the dividing wall extends axially and surrounding the rotor axis.

7. A rotor unit according to claim 6, wherein the dividing wall is joined to at least part of the separating discs at their radially inner portions.

8. A rotor unit according to claim 7, wherein the dividing wall is constituted by assembly joints, surrounding the axis of rotation, between all the pairs of mutually adjacent separating discs.

9. A rotor unit according to claim 7, wherein the assembled rotor unit also comprises entrainment means disposed radially within, and joined to, the dividing wall.

10. A rotor unit according to claim 9, wherein the entrainment means comprise inlet discs disposed coaxially with the axis of rotation in the inlet chamber and arranged for sparing entrainment during operation of the liquid mixture supplied.

11. A rotor unit according to claim 9, wherein said entrainment means take the form of parts of inner portions of said separating discs.

12. A rotor unit according to claim 9, wherein the entrainment means comprise blades extending radially and axially.

13. A rotor unit according to claim 9, wherein parts of said outlet delineate axially the space in which the separating discs constitute said entrainment means.

14. A rotor unit according to claim 1, wherein the separating discs are joined to one another at least at spacing means, which spacing means form part of the separating discs.

15. A rotor unit according to claim 1, wherein the dividing wall is joined to at least part of the separating discs at their radially inner portions.

16. A rotor unit according to claim 1, wherein said outlet comprises a number of inner portions of said separating discs.

17. A rotor unit according to claim 1, wherein all the separating discs in the rotor unit are identical.

18. A rotor unit according to claim 1, wherein the assembled rotor unit also comprises an outer dividing wall which is joined to at least part of the separating discs at their radially outer portions.

19. A rotor unit according to claim 18, wherein said outer dividing wall constitutes a rotor housing.

20. A rotor unit according to claim 1, wherein each separating disc is provided with a number of holes which constitute axial ducts when the separating discs are fitted in a stack.

21. A rotor unit according to claim 1, wherein parts of said outlet are disposed at radially inner portions of the separating discs.

22. A rotor unit according to claim 21, wherein parts of said outlet are joined to the separating discs at said dividing wall.

23. A rotor unit according to claim 1, wherein parts of said outlet are disposed at one of the axial ends of the separating discs.

* * * * *